US005323572A

United States Patent [19]

Guenin

[11] Patent Number: 5,323,572

[45] Date of Patent: Jun. 28, 1994

[54] PRECISION GRINDING MACHINE

[75] Inventor: Maurice Guenin, La Chaux-de-Fonds, Switzerland

[73] Assignee: Voumard Machines Co. S.A., La Chaux-de-Fonds, Switzerland

[21] Appl. No.: 879,288

[22] Filed: May 7, 1992

[30] Foreign Application Priority Data

May 7, 1991 [CH] Switzerland ..... 1377/91

[51] Int. Cl.[5] ..... B24B 49/00

[52] U.S. Cl. ..... 51/165.87; 51/5 D; 51/165.77; 29/39; 29/40

[58] Field of Search ..... 51/165.87, 5 D, 166 T, 51/165.87, 165.88, 165.77, 165.78; 82/120, 121; 29/39, 40; 125/11.04, 11.06

[56] References Cited

U.S. PATENT DOCUMENTS

| | | | |
|---|---|---|---|
| 3,627,490 | 12/1971 | Asano . | |
| 4,061,952 | 12/1977 | Dinsdale | 51/165.71 |
| 4,295,301 | 10/1981 | Barth | 51/165.88 |
| 4,420,910 | 12/1983 | Lorsson . | |
| 4,461,121 | 7/1984 | Motzer | 51/166 T |
| 4,481,739 | 11/1984 | Suzuki | 51/166 T |
| 4,535,572 | 8/1985 | Smith | 51/5 D |
| 4,570,387 | 2/1986 | Unno | 51/165.87 |
| 4,607,607 | 8/1986 | Janutta | 51/166 T |
| 4,653,235 | 3/1987 | Farmer | 51/165.87 |
| 4,755,950 | 7/1988 | Rao . | |
| 4,912,880 | 4/1990 | Haddock | 51/165.71 |
| 5,072,548 | 12/1991 | Girard | 51/165.87 |
| 5,095,788 | 3/1992 | Matoni | 82/120 |
| 5,097,632 | 3/1992 | Yamamori | 51/165.87 |

FOREIGN PATENT DOCUMENTS

| | | | |
|---|---|---|---|
| 281835 | 2/1988 | European Pat. Off. . | |
| 0281835 | 2/1988 | European Pat. Off. . | |
| 321669 | 10/1988 | European Pat. Off. . | |
| 2024212 | 12/1970 | Fed. Rep. of Germany . | |
| 2210069 | 9/1973 | Fed. Rep. of Germany . | |
| 3524690 | 3/1986 | Fed. Rep. of Germany . | |
| 3701124 | 7/1988 | Fed. Rep. of Germany . | |
| 48905 | 5/1989 | Fed. Rep. of Germany | 82/121 |
| 3736463 | 5/1989 | Fed. Rep. of Germany . | |
| 2647702 | 12/1990 | France . | |
| 88/03460 | 9/1987 | PCT Int'l Appl. . | |
| 49005 | 5/1990 | U.S.S.R. | 82/120 |
| 2002545 | 2/1979 | United Kingdom . | |

*Primary Examiner*—M. Rachuba
*Attorney, Agent, or Firm*—Oliff & Berridge

[57] ABSTRACT

A toolholder turret (3) is movable in the X and Z directions relative to a work table (2) so that each of the grinding tools (9*a*, 10*a*, 11*a* 12*a*) can be presented to machine a surface of a workpiece (6). A support (20) of a truing unit (4) bears a rotary body (22), one arm (23) of which is provided at the end with a follower, while two vertical arms are provided with diamonds. The exact positions of the truing tools relative to a reference, which may be constituted by the detecting surfaces of the follower, are detected by means of a further follower (18) integral with a further table (13). Measurements taken by displacement of the latter follower are stored in a memory. Other measurements relating to the actual sizes and shapes of the grinding tools are likewise taken through displacement of the further table so that these tools are sensed by the detecting surfaces of the first-mentioned follower. By means of these data, a truing program can be particularized, which then proceeds automatically and imparts a specific desired shape to the grinding wheels. Thereafter, the precision grinding operation on the workpiece can be automatically controlled.

14 Claims, 3 Drawing Sheets

PRECISION GRINDING MACHINE

Figure 1:
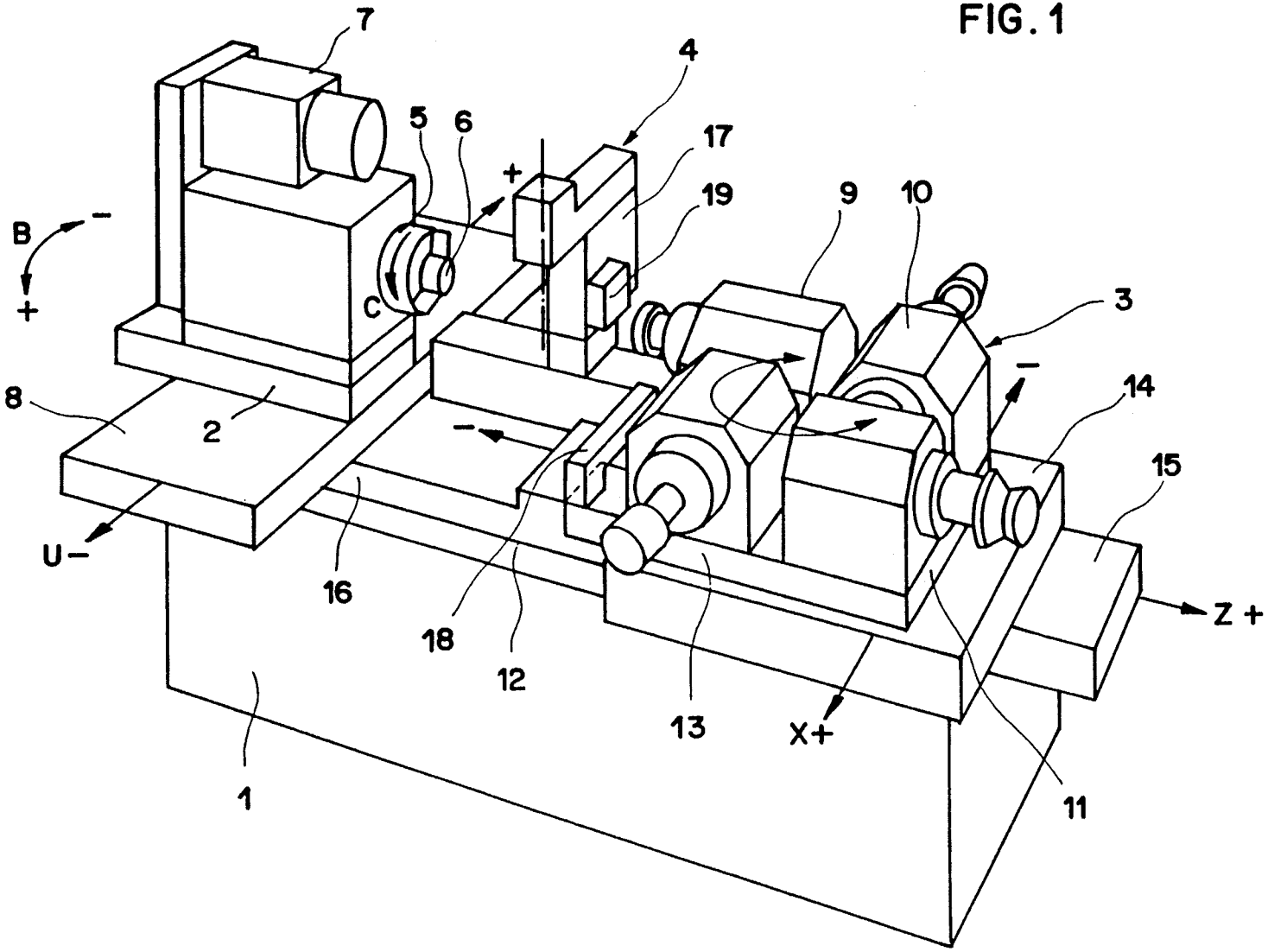

This invention relates to grinding machines, and in particular to a numerically controlled precision grinding machine of the type having, on a base, a work table, a truing turret, and a toolholder turret, respectively equipped with a driving spindle for a part to be machined, with at least one truing tool, and with at least one grinding tool, these turrets being capable of relative displacements at least on one of the axes X and Z between the toolholder turret, on the one hand, and the work table and the truing turret, on the other hand.

The invention further relates to a method of starting up a precision grinding machine equipped with a work table, with a toolholder holding at least one grinding tool, with a truing turret on which one or more truing tools having a truing edge are mounted, and with a numerical control comprising a memory, with a view to precision grinding operations on several different surfaces of a single part.

Recent developments in the field of precision grinding machines have confronted designers with various sorts of difficulties.

As the machines have become increasingly powerful, they have been equipped so as to be able to carry out increasingly varied operations. Thus, for example, the toolholder turret is currently often equipped with two, three, or even four grinding tools which can go into action successively during the course of each sequence of grinding operations carried out on a workpiece. The work table may be provided with a numerical axis of rotation for grinding internal or external conical surfaces of substantially circular shapes. Hence it has to be possible to position it precisely at will. Moreover, the machine is often equipped with several truing tools, e.g., with several diamond toolholders of different shapes and with a revolving cutter. Each of these different tools is brought into working position during each truing operation carried out on one or another of the grinding wheels mounted on the toolholder turret.

It will be obvious that this complex equipment tends to make it complicated, delicate, and long to start up any precision grinding machine with a view to carrying out grinding operations on a series of identical workpieces.

On the other hand, with the increase in speeds of rotation of the spindles and the complexity of arrangement of the toolholder turrets, the risks run by the operators who verify the exact positioning of the tools during the operations of truing the grinding wheels likewise increase considerably. It is for this reason, incidentally, that regulations have been imposed upon manufacturers concerning safety devices to be employed during operation of the grinding machines. The latter must be equipped with doors which cannot open unless safety measures have been taken, and especially unless the rotary spindles have been stopped. These difficulties and others therefore prompted a search for solutions.

It has been proposed in the art of linear-operating grinding machines, viz., in German Disclosed Application (DOS) No. 37 36,463, to fix a truing-tool support to the work table and a follower integral with the toolholder. These means allow determination of the exact position of the truing tools, and the operations of truing the grinding wheel can consequently be carried out knowledgeably. The same reference discloses the provision of a second follower in a fixed position and the verification of the final dimensions of the workpieces by means of this follower, whereby the amount of wear on the truing tools can be indirectly ascertained. However, the teaching of this reference applies only to linear grinding machines having a grinding wheel of which only the cylindrical surface is active. Moreover, the reference does not suggest any means by which a truing operation could be controlled automatically.

European Patent Application Publication No. 0 281 835 describes a truing turret in which several truing tools are mounted radially on a head capable of pivoting about its axis on the turret. This turret is integral with a rocking arm, the working position of which can be checked by means of a follower co-operating with a reference surface. However, neither does this reference indicate means for carrying out a truing operation completely automatically.

German Disclosed Application (DOS) No. 35 24,690 relates to the measurement of the characteristics of a disk-shaped grinding wheel and, in particular, to the use of piezoelectric-type followers for carrying out this measurement.

Finally, U.S. Pat. No. 4,420,910 has to do more particularly with carrying out precision grinding operations on internal cylindrical surfaces. In this case, the workpieces are fixed in the chuck of a rotating spindle, and the table on which the spindle is mounted bears a truing tool, so that the grinding wheel is trued by means of the movements of this table perpendicular to the axis of the grinding wheel. The operation is effected as a function of data supplied by a measuring instrument, without any automation of the truing operation being envisaged.

It has now been found that the various difficulties mentioned earlier can be overcome by relatively simple means.

It is an object of this invention to provide an improved precision grinding machine and method by means of which it is possible, in particular, in starting up a sequence of precision grinding operations, to simplify the work of the operator and to reduce greatly the time for adjustment, for truing the grinding wheels, and for machining until an acceptable first workpiece is obtained.

A further object of this invention is to provide a precision grinding machine and method by means of which operating safety is increased.

Still another object of this invention is to provide such a machine and method by means of which a truing operation can be carried out completely automatically for the purpose of eliminating the difficulties indicated above.

To this end, in the precision grinding machine according to the present invention, of the type initially mentioned, the toolholder turret and another part of the machine are respectively equipped with a first position follower and with a reference block, the numerical control being arranged for the automatic execution of a starting-up operation comprising a measurement-taking step during which the follower is successively brought into predetermined relative positions with respect to at least one of the truing tools and with respect to at least one of the surfaces of the reference block.

The method according to the present invention for starting up a precision grinding machine comprises the steps of placing a follower having at least two detecting faces in a predetermined position on the toolholder, carrying out a measurement-taking step wherein the detecting faces of the. follower are brought into predetermined relative positions with respect to one or more truing edges of the truing tool or tools, and storing in the memory the positions of the toolholder corresponding to each of these predetermined relative positions, and after the measurement-taking step, using the stored recordings of positions for programming an automatic truing operation.

In a further embodiment of this method, a second follower situated in a predetermined position relative to a machine reference is also used, and by means of this second follower, position measurements are taken of surfaces of the grinding tool or tools so as to be able to determine the initial dimensions of the tools and to program the automatic truing operation accordingly.

Figure 2:
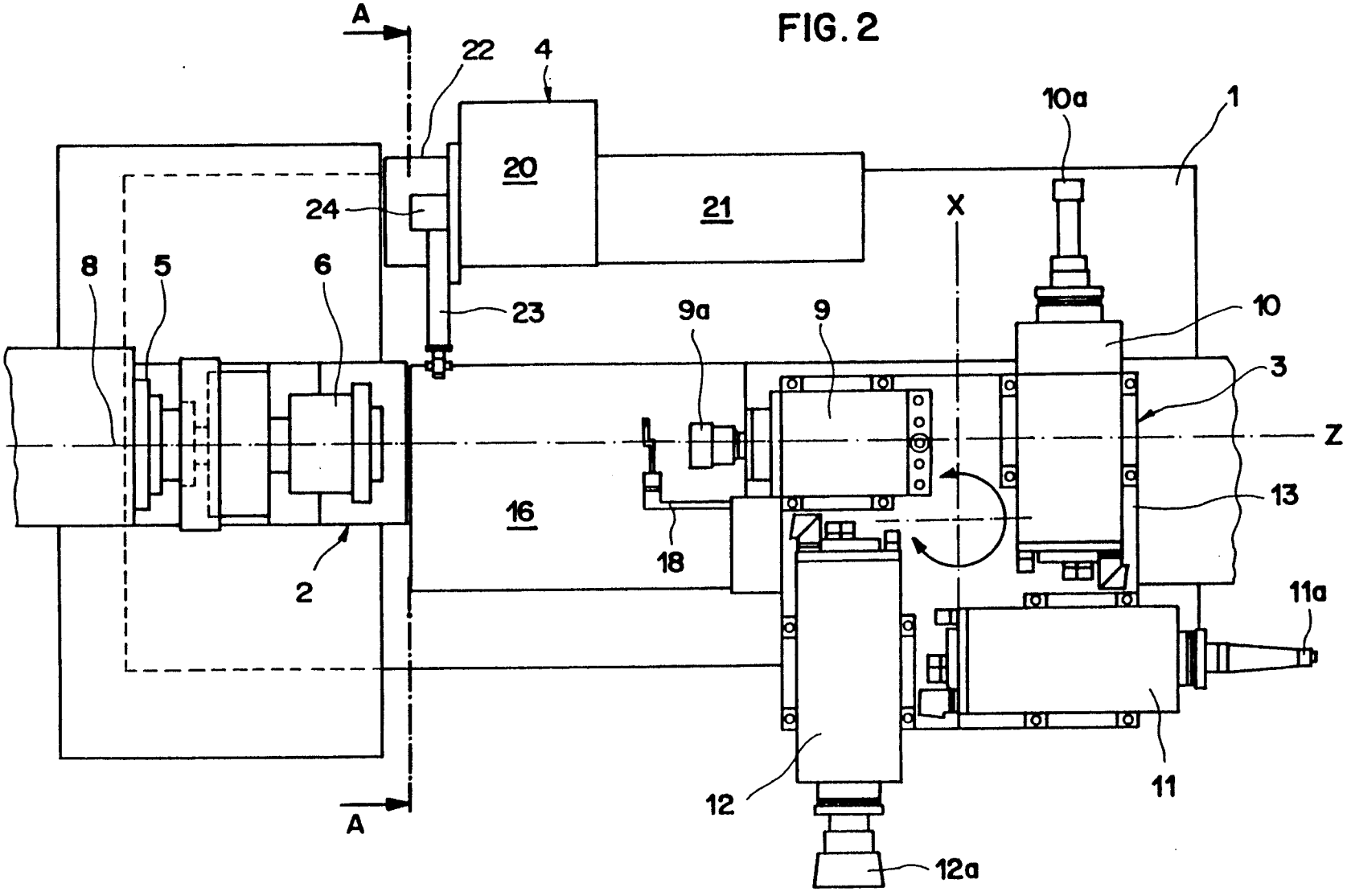
Figure 3:
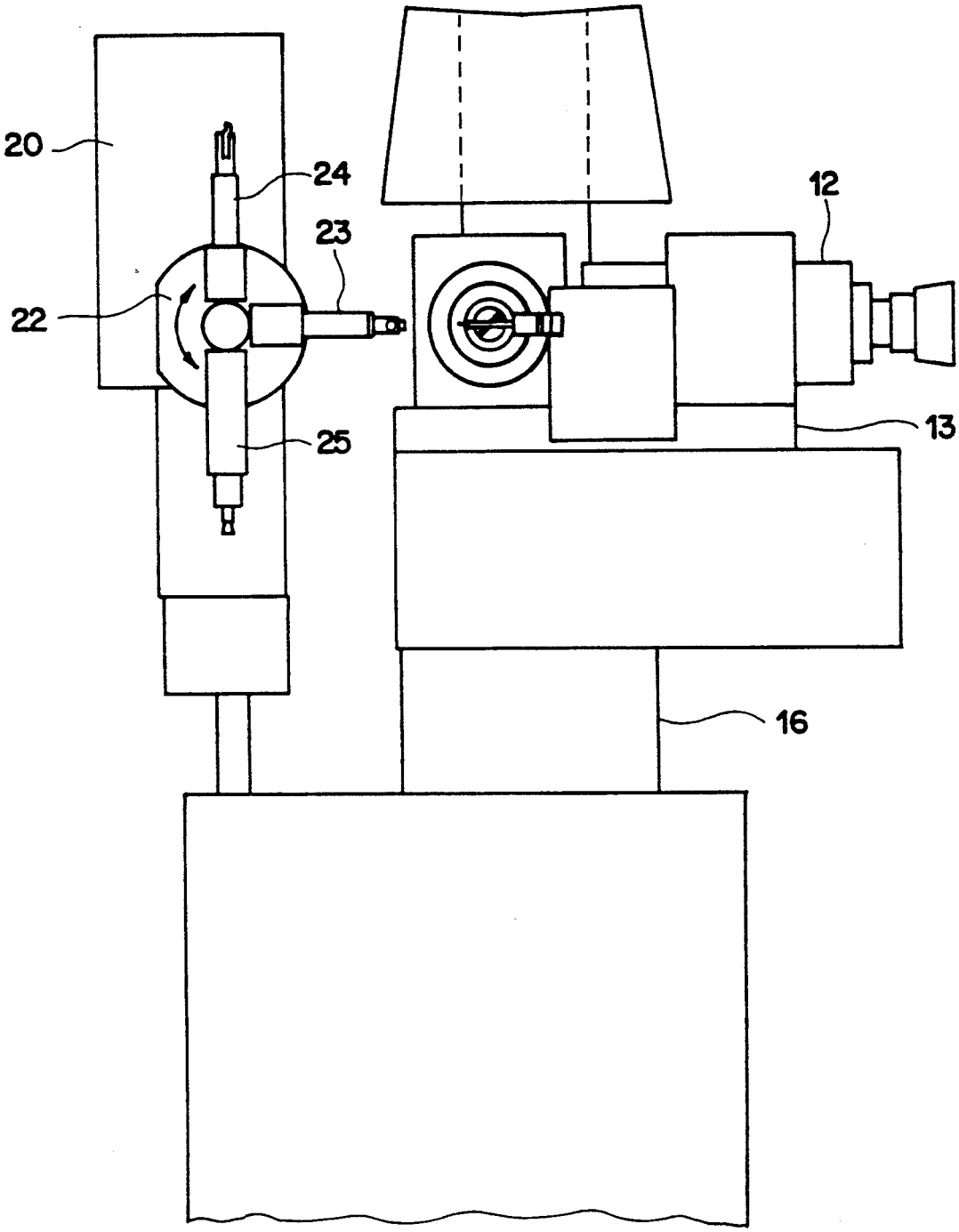

Preferred embodiments of the invention, as well as certain optional particularities thereof, will now be described in detail with reference to the accompanying drawings, in which:

FIG. 1 is a diagrammatic perspective view of a precision grinding machine equipped for carrying out the inventive method, FIG. 2 is a top plan view of a precision grinding machine of a different type from that of FIG. 1, likewise equipped for carrying out the inventive method, and FIG. 3 is a section taken on the line A—A of FIG. 2.

The precision grinding machine illustrated in FIG. 1 comprises the following different main items of equipment: a base 1, a work table 2, a toolholder turret 3 for grinding tools, and a truing turret 4. Table bears a workpiece spindle 5 driven rotatingly about a horizontal axis by a motor 7. Fixed to spindle 5 is a workpiece 6 to be machined. Work table 2 is movable on base 1, firstly about a vertical axis of rotation (axis B), and secondly because it is mounted on a mobile table 8 moving on an axis parallel to the X axis, on the other hand. Table 8 might be fixed instead.

Turret 3 comprises four grinding tools 9, 10, 11, and 12 fixed to a table 13 borne by a slide system. As illustrated in FIG. 1, this system comprises a transverse slide 14 movable on the X axis and a longitudinal slide 15 movable on the Z axis on a slide-bar 16. As a variation, the slide system might include just the Z axis (slide 15 movable on slide-bar 16).

Finally, truing unit 4 comprises a support 17 to which one or more rotating or fixed truing tools may be secured.

For carrying out the method, the machine shown in FIG. 1 comprises various elements, some of which are not shown. It is a numerically controlled machine, so that a computer having a memory and a data-entering device is associated therewith. Furthermore, fixed to table 13 is a follower 18 having a head which bears two sensors, each with a plane detecting face. These faces are oriented on the X and Z axes, respectively. Follower 18 is thus capable of transmitting signals when one or the other of its detecting faces comes up against an obstacle or is situated at a predetermined minimum distance from the part to be detected. The signals cause the position of table 13 to be stored at the moment when they are transmitted. They make it possible to control table 13. The movements of follower 18 are controlled via the movements of table 13, i.e., by manipulations of slides 15 and 14 supporting table 13. The positions of table 13 are entered in the computer relative to a machine reference which may consist of a reference block physically secured to a predetermined location of base 1, or which may instead be simply incorporated in the memory of the machine. Follower 18, the support of which in the form of a fixed arm may be seen in FIG. 1, may therefore be moved within the entire sweep of slides 14 and 15. In particular, it can take position measurements of two reference faces of a block 19 in the form of a rectangular parallelepiped secured to the support 17 of truing unit 4. As may be seen in FIG. 1, the vertical faces of reference block 19 are oriented on the X and Z axes. As the head of follower 18 includes two position sensors having vertical plane surfaces oriented in the X and Z directions, these two plane faces being fixed relative to one another, the Z face of follower 18 can, by a movement of table 13 in the Z direction, be brought up against the corresponding face of block 19, and the exact position of truing unit 4 on the Z axis can be measured. By means of a similar operation, the position of truing unit 4 on the X axis can likewise be measured.

A starting-up program may therefore comprise instructions for moving table 13 as indicated above and, in addition, for bringing the X and Z faces of the sensors of follower 18 in contact with selected edges on the various diamonds. The position values thus determined and stored are then used for determining the exact positions of the diamonds relative to the machine reference. Since, for one thing, the positions of table 13 are constantly referenced relative to the machine reference, and for another thing, nominal values can be assigned to the grinding wheels for their diameters and the positions of their front faces, there are sufficient elements available for programming an automatic truing operation. These elements are introduced into the program, after which table 13 is moved in such a way that each of the grinding wheels 9*a*, 10*a*, 11*a*, and 12*a* successively comes in contact with a diamond placed in working position. The machining diameter of each of the grinding wheels, as well as the position of one of the flat faces of the grinding wheels in any case, can be introduced into the program as nominal values, the various truing operations proceeding until the nominal values have been reached. Thus, the truing operation can be carried out in several successive phases until each of the grinding wheels has attained the desired shape and size. In this embodiment of the method, the axes are positioned taking into account the maximum diameter of the grinding wheels, and the latter are moved until they come in contact with the diamonds.

Follower 18 may likewise be used for measuring and storing the positions of one or more surfaces of workpiece 6. By means of these data, the approach and operation of the tools can then be controlled when the first workpiece of the series is machined. Thus, machining of this first workpiece can be speeded up, for the tool controls can take place at an accelerated rate up to a short distance from the surfaces which are to come in contact with the tools or with the follower, the remainder of the movement taking place at a slow rate.

Storing the position of the workpiece attached to spindle 5 may also be useful otherwise, for it is thus possible to know with absolute certainty what movements must be imparted to table 13 in order to machine a surface if this surface is machined when work table 2 is positioned obliquely relative to the Z axis. Taking the measurements, by means of follower 18, of one or more surfaces of workpiece 6 makes it possible to situate the positions of these surfaces relative to the center of rotation of table 2 and, consequently, to calculate the respective positions of these surfaces after the table has pivoted.

Storing the positions of the essential edges of the diamonds relative to reference block 19, via follower 18, is not only useful for permitting completely automatic truing operations. It also permits repetition of the measuring operation on the truing tools while underway. Thus, any wear on the diamonds can be detected and taken into account in the intermediate operations of truing the grinding wheels to be effected during the machining of a series of identical workpieces. Possible deflections in readings due to wear on the diamonds are avoided, and series of a large number of identical parts can be machined with precision, and completely automatically.

The sensors of follower 18 are elements known per se. Thus, for example, the plane surface of the sensor may be a face of a terminal integral with an electrical contact and supported by a spring facing another contact which is fixed, the arrangement being such that closing of the switch takes place as soon as this terminal touches a foreign body, thereby causing a signal to be transmitted in the detection circuit. However, any other sensor design may be used, including those without contact permitting an approach to rotating truing tools. In order to be able to work in a complete manner, follower 18 should comprise at least two sensors, or even three in some cases, two of which are oriented in opposite directions on the Z axis and the third on the X axis.

Furthermore, in one preferred design of the device described, follower 18 is mounted retractably on table 13, support arm 18 being telescopic or pivoting so as to free during machining the space it occupies during starting up and to allow the machining operations to proceed freely.

As regards the advantageous effects of the method described, still others may be cited than those mentioned above. Thus, in particular, as the positions of the diamonds and of the workpiece have been determined by the follower and stored, the numerical control program can carry out an operating check on those positions at any moment.

In addition, starting from the stored positions, it is further possible to carry out an anti-collision compatibility check of the machining program introduced into the numerical control. This compatibility check can, for example, cause an alarm to go off in case of a risk of endangering the tools or the workpiece. Provision may likewise be made for graphic visualization of the risks of collision on the control monitor.

A further embodiment of a precision grinding machine for carrying out the foregoing starting-up program will be described below. However, before going on with the description of this other embodiment, it may be mentioned that in a modification of the embodiment of FIG. 1, reference block 19 might be introduced into the rotary assembly of the diamond holders instead. In that case, this reference block would be integral with the diamond holders but could be brought into an active position by rotation of the assembly, any other rotary movement bringing a truing tool into active position.

FIGS. 2 and 3 show a grinding machine which is different from the one in FIG. 1 and in which the means for carrying out the starting-up method described are designed differently in part. In FIGS. 2 and 3, the elements of the grinding machine which are of the same nature and play the same part as the corresponding elements of the grinding machine of FIG. 1 are designated by the same reference numerals. Thus, there is still a base 1, a work table 2, a toolholder turret 3, and a truing turret 4. Work table 2 also comprises a spindle 5 bearing a workpiece 6 and rotating about a vertical axis 8.

Toolholder turret 3 is supported by a table 13. It can likewise move on the Z axis and on the X axis. It is equipped with four grinding devices 9, 10, 11, 12, each bearing a grinding wheel of a particular size and shape. The axes of rotation of the grinding wheels are oriented either on the Z axis or on the X axis. They may be orientable on the X, Z plane. FIG. 2 also shows follower 18, the head of which comprises three position sensors, one having a surface oriented perpendicular to the X axis and the other two having respective surfaces oriented perpendicular to the Z axis in opposite directions.

Here truing turret 4 has a particular arrangement. It comprises a base 20 mounted on a longitudinal support 21. Although the truing turret 4 illustrated in FIG. 2 has three arms, it might have a greater number of arms. Base 20 supports a horizontal-axis rotary body 22 oriented parallel to the Z axis. Of the three arms 23, 24, and 25 of body 22, arm 23 is positioned in FIG. 3 horizontal to the level of the axis of spindle 5 and grinding tools 9 and 12. When arm 23 is in this position, arm 24 is positioned vertically upward and arm 25 vertically downward. Thus, the truing device includes a resting position when body 22 is positioned so that arm 23 is pointing to the rear of the machine. The space between body 22 and the principal axis of the machine is then completely free.

Arm 23 constitutes a second follower, having three sensors mounted on the end of it, e.g., sensors formed by spring-loaded contact terminals triggered when the plane outside surface of a terminal touches the object to be measured. For two of the sensors, the plane surfaces of these terminals are oriented on the Z axis in opposite directions, and for the third on the X axis, as may be seen in the plan view of FIG. 2. Arm 24 bears a diamond, while arm 25 bears a diamond-set cutter driven rotatingly by a motor accommodated in arm 25. In this arrangement, there is no reference block analogous to block 19 in the first embodiment, but the function of this block is performed by the surfaces of the sensors of arm 23, as will be seen below. It should be noted, however, that in one modification, a reference block analogous to block 19 might equally well be fixed against support 20 or on another arm.

The functions of follower 23 are as follows: this follower is intended to allow storage of the data relative to grinding wheels 9*a*, 10*a*, 11*a*, and 12*a*, particularly their actual dimensions before the truing operation, in order that this operation may be carried out precisely.

With the grinding machine of FIGS. 2 and 3, the starting-up method starts as described with reference to FIG. 1 by taking position measurements of the determinant edges of the truing tools. Table 13 is therefore moved so that the detecting surfaces of follower 18 come in contact with the reference block and with each of the tools borne by turret 20. In the case where it is follower 23 which acts as a reference block, the sensors mounted on follower 23 are elements having an actuating force which is a multiple of the force necessary for actuating follower 18. Hence these sensors can act as the reference block for follower 18. Once follower 18 has located the positions of the truing tools, and possibly that of the workpiece, the program comprises a step of measuring the real dimensions of the grinding wheels. Table 13 is moved along the X and Z axes in such a way that certain characteristic surfaces of tools 9*a*, 10*a*, 11*a*, and 12*a* come in contact with the detecting surfaces of follower 23. These characteristic surfaces will be the cylindrical surface and, for example, the front face for a cylindrical grinding wheel. In the case of a conical grinding wheel, such as grinding wheel 12*a*, for instance, location of the surfaces is carried out on the front face and on the greatest diameter. The data obtained are stored as relative values, i.e., in the form of position readings relative to the machine reference. The data previously obtained by follower 18 will be used for that purpose on the positions of the detecting surfaces of follower 23.

It will further be noted that in the modification described here, in which a second follower in the form of follower 23 is used for determining the dimensions of the grinding wheels prior to truing, the positioning of a grinding wheel on the follower is determined as a function of the shape of the grinding wheel. It is the highest point of the cross-section which is used for sensing the diameter of the grinding tool, and the foremost point for the front sensing. With certain grinding wheels having special shapes, the programming may require that other values be entered in the computer. However, all the operations can be carried out automatically, without exaggerated complication, at no great difficulty by the means described here. It is possible to take the readings between the various diamonds mounted on the truing device with utmost precision.

In certain cases where one or another of the tools mounted on table 13 is a grinding tool, such as a diamondset grinding wheel, whose characteristics neither permit nor require truing, the taking of measurements carried out by the second follower 23 will be used only for determining the actual position of this tool. At the time of automatic truing, this tool is not brought into contact with the diamonds. On the other hand, the position data picked up may be used for carrying out the precision grinding operation on the workpiece.

As will be obvious from the two embodiments described above, the automatic starting-up method can be carried out under the most varied conditions. It may be used not only on grinding machines having a toolholder turret movable along X and Z axes relative to the work table and the truing turret, but also in the case of grinding machines in which the toolholder turret is movable in only one direction, e.g., on the Z axis, and it is the work table and the truing turret which can be moved in the X direction.

What is claimed is:

1. An automatic execution grinding machine having a base and, on said base; a worktable provided with a workpiece spindle; a truing turret provided with one or more truing tools, each truing tool having at least one truing edge; a toolholder turret provided with one or more grinding tools; moving means for effecting relative displacements along at least one of an X axis and a Z axis between said toolholder turret on the one hand and said worktable and said truing turret on the other hand; and numerical control means arranged for automatic execution of successive sets of said relative displacements, said sets comprising sequences of grinding operations effected with said at least one grinding tool on at least one surface of a workpiece held by said spindle, wherein the improvement comprises:

a first follower on said toolholder turret, having a fixed active position with respect to said toolholder turret, and having at least two sensor faces oriented on said X and Z axes respectively, said faces having fixed positions relative to one another;

a reference block having a fixed active position with respect to said base, provided with at least two reference faces oriented on said X and Z axes respectively; and said numerical control means automatically controlling starting-up operations to perform a measurement taking step whereby said first follower is successively brought into predetermined relative positions with respect to said at least one truing edge and said at least two reference faces of the reference block so as to bring said sensor faces into coincidence positions with said at least one truing edge and with said reference faces, each sensor face being brought in a coincidence position with a corresponding reference face, and to provide and store data corresponding to an actual relative position of said at least one truing edge with respect to said reference block.

2. The grinding machine of claim 1, wherein said truing turret is provided with a second follower, further comprising means for storing the relative positions of said second follower relative to said truing tools, said relative displacements between said toolholder turret and said truing turret enabling said second follower to take position measurements on one or more surfaces of each of said grinding tools.

3. The grinding machine of claim 2, further comprising a rotating assembly mounted about an axis on said truing turret and including an arm and one or more truing tools, said second follower being integral with said arm.

4. The grinding machine of claim 2, wherein said first and second followers each comprise at least two sensors, each sensor having a plane detecting face, and wherein for each follower, said faces are oriented on the X and Z axes, said faces for said at least two sensors being fixed relative to one another.

5. The grinding machine of claim 4, wherein at least one of said followers comprises a third sensor having a detecting face oriented on the Z axis and so disposed as to be capable of effecting a position measurement of a rear face of one of said truing tools or grinding tools.

6. The grinding machine of claim 4, wherein said detecting faces of said second follower act as said reference faces of said reference block.

7. The grinding machine of claim 1, further comprising an arm, said first follower being borne by said arm and being retractable on said toolholder turret.

8. A method of starting up a precision grinding machine equipped with a work table, a toolholder holding at least one grinding tool, a truing turret whereon one or more truing tools having a truing edge are mounted, and a numerical control comprising a memory, for carrying out precision grinding operations on several different surfaces of a single workpiece, wherein the improvement comprises the steps of:

placing a follower having at least two detecting faces in a predetermined position on the toolholder, carrying out a measurement-taking step wherein the detecting faces of the follower are brought into predetermined relative positions with respect to one or more truing edges of the truing tool or tools, storing in the memory the positions of the toolholder corresponding to each of these predetermined relative positions, and using the stored recordings of positions for programming an automatic truing operation.

9. The method of claim 8, wherein the measurement-taking step comprises relative displacements of the follower toward a reference block associated with the truing turret and toward each of the truing tools.

10. The method of claim 8, wherein, in the measurement-taking step, a second follower, situated in a fixed and predetermined position relative to a machine reference, takes position measurements of surfaces of a grinding tool or tools, these measurements are used for determining initial dimensions of the grinding tool or tools, and these initial dimensions are also used for particularizing the truing program.

11. The method of claim 10 applied to a precision grinding machine comprising a diamond set grinding tool which does not permit truing, wherein the surface position measurements of this tool are utilized solely for determining the position of the tool.

12. The method of claim 8, wherein it comprises a step of preparation for grinding wherein the follower associated with the toolholder takes at least one position measurement of a surface of the workpiece, and this measurement is entered in the memory for particularizing a precision grinding program.

13. The method of claim 12 applied to a precision grinding machine in which an angular numerical axis is associated with the work table, wherein the position measurement or measurements of surfaces of the workpiece are used for determining the relative position of the workpiece with respect to the center of rotation of the work table and, consequently, the positions of the workpiece after any angular movement of the work table.

14. The method of claim 8, wherein at least some of the operations effected during the measurement-taking step are repeated during the machining of a series of identical workpieces, and the measurements are used for correcting said truing program taking into account wear and tear on the truing tools determined by means of said measurements taken repeatedly.

* * * * *